US005958536A

United States Patent [19]

Gelsinger et al.

[11] Patent Number: 5,958,536

[45] Date of Patent: Sep. 28, 1999

[54] SELF-ADHESIVE LABEL WITH DETACHABLE STICKER

[75] Inventors: Timothy L. Gelsinger, Long Valley, N.J.; Michael DiMatteo, Staten Island, N.Y.

[73] Assignee: The Challenge Printing Company, Wallington, N.J.

[21] Appl. No.: 08/812,743

[22] Filed: Mar. 6, 1997

[51] Int. Cl.[6] ..... B42D 15/00

[52] U.S. Cl. ..... 428/40.1; 40/310; 40/312; 40/638; 283/81; 428/42.1; 428/42.2; 428/42.3; 428/43; 428/192; 428/194; 428/914

[58] Field of Search ..... 428/40.1, 42.1, 428/42.2, 42.3, 43, 192, 194, 914; 283/81; 40/638, 310, 312

[56] References Cited

U.S. PATENT DOCUMENTS

| | | | |
|---|---|---|---|
| 4,055,249 | 10/1977 | Kojima | 428/42.1 |
| 4,983,438 | 1/1991 | Jameson | 428/42.3 |
| 5,056,827 | 10/1991 | Sasso | 283/105 |
| 5,172,936 | 12/1992 | Sullivan et al. | 283/81 |
| 5,472,756 | 12/1995 | Sechet | 428/40.1 |
| 5,484,168 | 1/1996 | Chigot | 428/41.8 |
| 5,658,631 | 8/1997 | Bernstein | 428/42.3 |

*Primary Examiner*—Nasser Ahmad
*Attorney, Agent, or Firm*—Proskauer Rose LLP

[57] ABSTRACT

A self-adhesive label for a bottle, such as a pharmaceutical stock bottle, comprises an adhesive layer and a release-liner. An adhesive section and a detachable section are die cut into the adhesive layer. The adhesive and detachable sections are removably attached to a release-liner which is coated with a non-stick composition. The detachable section is superimposed on a portion of the release-liner which is larger than the detachable section but smaller than the adhesive section. When the adhesive layer is separated from the release liner and adhered to a first surface, the detachable section of the adhesive layer remains under the detachable section. The first surface may be a pharmacist's stock bottle. Thus, the detachable section (e.g., a sticker containing useful information for a patient) may be detached from the balance of the label and adhered to second surface, such as the surface of a patient's bottle.

12 Claims, 2 Drawing Sheets

SELF-ADHESIVE LABEL WITH DETACHABLE STICKER

FIELD OF THE INVENTION

The present invention relates to a self-adhesive label with a detachable sticker. The self-adhesive label can be used on bottles of all kinds, such as a stock bottle containing a pharmaceutical product. When the self-adhesive label is used on a stock bottle containing a pharmaceutical product, the detachable sticker may be removed from the stock bottle by the pharmacist and permanently adhered to another surface such as a prescription bottle or a chart.

BACKGROUND OF THE INVENTION

One of the problems faced when designing labels for pharmaceutical products is to design a label that can permanently adhere to a stock bottle, and at the same time, contain a detachable section, such as a sticker, that may be permanently adhered to a prescription bottle once removed from the stock bottle. This type of label would be useful to a pharmacist when dispensing medication.

It is commonplace for a pharmacist to dispense pills from large stock bottles into prescription bottles. It is also commonplace for certain medications to be stored in powder form, but be dispensed to the patient as a suspension. For example, amoxycillin is usually stored in a lyophilized state, but dispensed as a suspension. Therefore, the pharmacist must remove a portion of the stored amoxycillin from a stock bottle, and then suspend the powdered amoxycillin in a solvent according to the specifications of the prescription. The suspended amoxycillin may then be dispensed to a patient in a prescription bottle or vial. When dispensing medication in either the solid or liquid form, often the pharmacist provides the patient with instructions to be followed when taking the medication, for example, instructions to "SHAKE WELL," "TAKE WITH FOOD," etc.

Using the labeling systems available today, a pharmacist must consult either a manual, computer program, or written information provided by the pharmaceutical company in order to determine the nature of the instructions that must be provided to the patient with a particular medication. Once the pharmacist determines the nature of the instructions that must be provided to the patient, the pharmacist must either type the information on a label to be attached to the patient's bottle, or adhere a sticker preprinted with the instructions to the patient's bottle. The most commonly used approach is to use preprinted stickers to convey the instructions to the patient. These stickers are usually located on large roll dispensers in a remote area of the stock room. The large roll dispensers frequently hold many different types of instruction stickers. Applying the proper preprinted sticker to the patient's bottle is both time consuming and prone to mistake.

The process is time consuming because the pharmacist must first walk to a different location of the stock room to locate the sticker dispensers. Once the sticker dispensers are located, the pharmacist must then determine which preprinted sticker is required for the particular medication and adhere it to the prescription bottle. This process can take several minutes to accomplish.

This process is also prone to mistake since the possibility of placing the wrong instruction sticker on a prescription bottle increases when all of the instruction stickers are stored together on large rolls. Providing the wrong instructions to the patient when taking medication may sometimes prove dangerous.

Numerous self-adhesive labels are known in the prior art. For example, U.S. Pat. No. 5,056,827 (Sasso), U.S. Pat. No. 5,472,756 (Sechet), and U.S. Pat. No. 5,172,936 (Sullivan et al.) all disclose self-adhesive labels. However, none of these patents discloses a self-adhesive label which is applied to a pharmaceutical stock bottle which overcomes these problems.

SUMMARY OF THE INVENTION

The disadvantages discussed above may be avoided by permanently adhering a label to a stock bottle that contains easily detachable instruction stickers which, when removed from the label, may be permanently adhered to the prescription bottle in which the medicine is dispensed. Alternatively, the stickers, once removed from the stock bottle, can also be applied to other surfaces such as charts, posters, or record keeping books. This type of label is more efficient for the pharmacist, since the stickers are right at the pharmacist's fingertips. In addition, this label can drastically reduce the possibility that the pharmacist might place the wrong instruction sticker on a prescription bottle.

Although the self-adhesive label is described as being used on a stock bottle containing a pharmaceutical product, it is evident that the self-adhesive label may also be used on other kinds of bottles, such as oil bottles, cosmetic bottles or food containers.

In accordance with the above characteristics and desired advantages, the self-adhesive label of the present invention comprises an adhesive layer superimposed on a release-liner. The adhesive layer has an adhesive section and a detachable section, each of which has an adhesive backing. The release-liner includes a portion on which the detachable section of the adhesive layer is superimposed. This portion of the release-liner remains under the detachable section after the adhesive section is adhered to a first is surface. Thus, the detachable section (e.g., a sticker) may then be removed from the first surface and adhered to a second surface.

The inventive self-adhesive label is used advantageously on stock bottles containing pharmaceutical products. The selfadhesive label is especially useful for pharmacists who must often give instructions to patients when dispensing prescription medication. These instructions can include: "TAKE WITH FOOD," "SHAKE WELL," or other similar statements. Detachable stickers having an adhesive backing with these statements printed on them greatly assist the pharmacist in the accurate dissemination of 25 information from the stock bottle to the prescription bottle.

In a preferred embodiment, a detachable tab is attached to each of the detachable stickers which facilitates gripping of the detachable stickers when detaching them from the self-adhesive label.

DETAILED DESCRIPTION OF THE PREFERRED EMBODIMENTS

Figure 1:
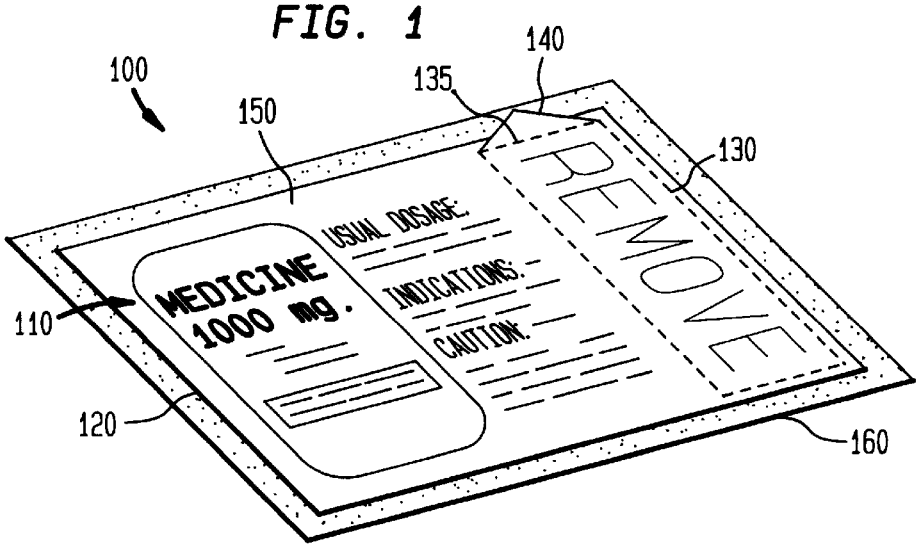
FIG. 1 shows a self-adhesive label in accordance with an illustrative embodiment of the invention.

FIG. 1 illustrates a self-adhesive label 100 in accordance with one embodiment of the invention. The self-adhesive label 100 comprises an upper adhesive layer 110 having an adhesive backing superimposed on a siliconized release-liner 160. The adhesive layer 110 comprises an adhesive section 120, and a detachable section 130, e.g., a removable sticker.

The adhesive layer 110 is produced by die cutting into a web which has been imprinted with useful information. However, the die is not permitted to pass through the release-liner 160 underneath. Thus, the adhesive section 120 is formed with a display surface 150 which is imprinted with important information for the pharmacist. The imprinted information may indicate the origin of the pharmaceutical product contained in the stock bottle. Additional information, such as, the type of pharmaceutical product in the bottle, the lot and batch number of the pharmaceutical product in the bottle, and the bar code used to identify the pharmaceutical product, may also be imprinted on the display surface 150 of the self-adhesive label 100. The display surface 150 may be laminated to protect the printing placed on the display surface 150 of the self-adhesive label 100.

The detachable section or sticker 130 is produced as part of the first die cutting operation or in a second die cutting operation done from above. The die cut for the detachable section is made into the adhesive section 120 without cutting into the release-liner 160. The detachable section 130 is thus fully contained within the perimeter of the adhesive section 120. The detachable section 130 lies on a portion 170 (see FIG. 2) of the release liner 160. This portion 170 is formed in a separate diecutting operation, this time from below, into the release liner 160. When the detachable section 130 is separated from the underlying portion 170 of the release-liner 160, due to its own adhesive backing, the detachable section 130 may be permanently adhered to another surface such as a prescription bottle, chart or pharmaceutical record.

The geometric shape of the detachable section 130 may vary, provided that the geometric shape is contained within the adhesive section 120. Desirably, the detachable section or sticker 130 is imprinted with useful information for the patient, for example, "TAKE WITH FOOD," "SHAKE WELL," "MAY CAUSE DROWSINESS," etc. In addition to instructions, the detachable section 130 may have dates, batch numbers or other appropriate information imprinted thereon.

Advantageously, a detachable tab 140 is attached to the detachable section 130 along a perforated line 135. The tab 140 either does not have an adhesive backing, or is originally formed with an adhesive backing which is later deactivated. Since the tab 140 does not adhere to the release-liner 160, it extends upwardly from the surface of the release-liner 160 along the perforated line 135. This orientation makes it easier for the pharmacist to grip the tab 140 in order to facilitate detachment of the detachable section 130 from the underlying portion 170 of the release-liner 160. Once the detachable section 130 is adhered to a surface such as a patient's bottle, the tab 140 may be separated from the rest of the detachable section 130 along the line of perforation 135 and discarded.

Figure 2:
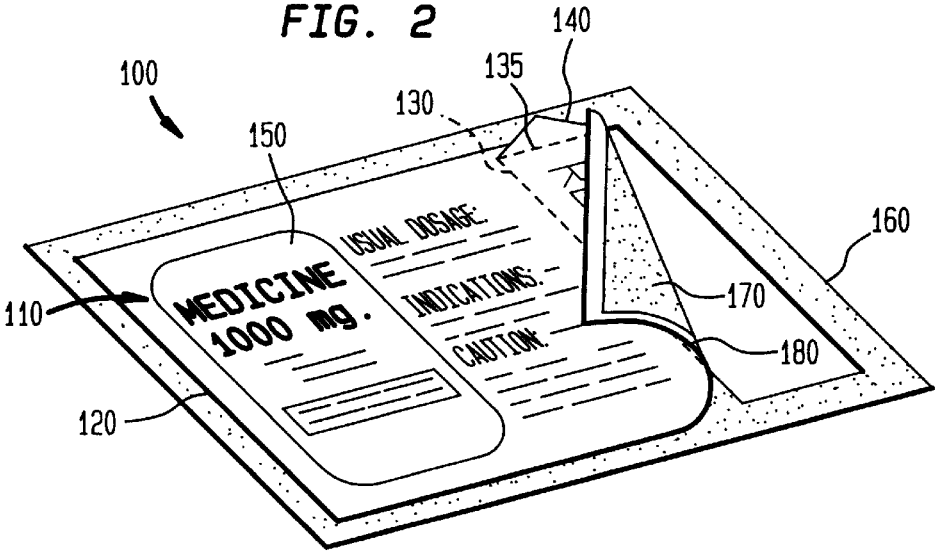
FIG. 2 shows the label of FIG. 1 in which a portion of the label has been removed from its release-liner.

FIG. 2 illustrates the embodiment of FIG. 1 with the adhesive layer 110 being partially raised from the underlying release-liner 160. In FIG. 2, the portion of the release-liner 170 on which the detachable section is superimposed is shown lifted from the rest of the release liner 160. As mentioned, the portion 170 of the release-liner 160 is die cut from below into the release-liner 160, but not into the adhesive layer 110. Thus, when the adhesive layer 110 is separated from the release liner 160, the portion 170 travels with the adhesive layer 110. The portion 170 is slightly larger than the detachable section 130, but smaller than the adhesive section 120. Thus, a marginal area 180 of adhesive section 120 encloses portion 170 of release liner 160. As a result, the portion 170 of the release-liner 160 remains attached to the adhesive section 120 and the detachable section 130 when the adhesive layer 110 is separated from release liner 160 and is adhered to a stock bottle.

When the adhesive layer 110 of self-adhesive label is separated from the release-liner 160, the adhesive backing of the adhesive section 120 becomes exposed, but the portion 170 of the release-liner 160 remains in place under the marginal area 180 of the adhesive section 120 and under the detachable section 130. The adhesive section 120 can then be permanently attached to a bottle via its adhesive backing. Furthermore, the marginal area 180 of adhesive section 120 ensures that portion 170 of release liner 160 is sealed onto the surface. Nonetheless, the detachable section 130 may be separated from the portion 170 of the release-liner 160 on which it is superimposed, e.g., by grasping the tab 140, and the adhesive backing of the detachable section 130 becomes exposed. The detachable section 130 may then be permanently adhered to a second surface, such as, a prescription bottle. Finally, the tab 140 may be detached from the detachable section 130 along the line of perforation 135 and discarded.

Figure 3:
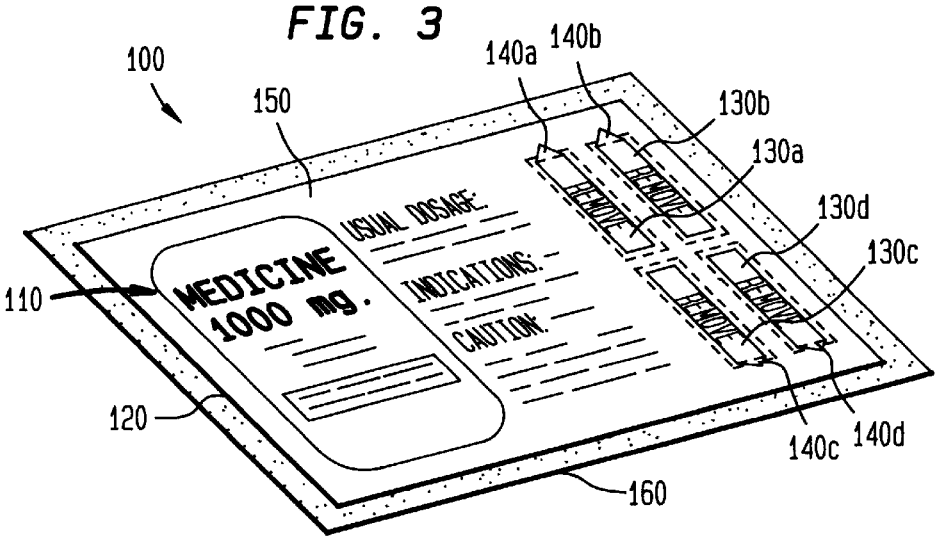
FIG. 3 shows another embodiment of the inventive label.

FIG. 3 shows another embodiment of the inventive self-adhesive label wherein a multiplicity of detachable sections 130*a*, 130*b*, 130*c*, 130*d* are die cut into the adhesive section 120. Each of the smaller sections 130*a*, 130*b*, 130*c*, 130*d* is superimposed on a portion 170 of the release-liner 160 in the same manner as described in FIGS. 1 and 2. Accordingly, each of the smaller detachable sections 130*a*, 130*b*, 130*c*, 130*d*, when removed, may be permanently adhered to a second surface, such as, the surface of a prescription bottle.

FIG. 3 also illustrates detachable tabs 140*a*, 140*b*, 140*c*, 140*d* which are detachably connected to each of the smaller detachable sections 130*a*, 130*b*, 130*c*, 130*d* along perforation lines. Each of the detachable tabs 140*a*, 140*b*, 140*c*, 140*d* has a non-adhesive backing. The detachable tabs 140*a*, 140*b*, 140*c*, 140*d* may originally be formed with an adhesive backing, which is later deactivated. Since the detachable tabs 140*a*, 140*b*, 140*c*, 140*d* do not have an adhesive backing they do not adhere to the release-liner and therefore extend up from the release-liner 160. This orientation makes it easier for a person to grip one of the detachable tabs 140*a*, 140*b*, 140*c*, 140*d* in order to facilitate detachment of one of the smaller detachable sections 130*a*, 130*b*, 130*c*, 130*d* from the portion 170 of the release-liner 160 on which they are superimposed.

The detachable tabs 140*a*, 140*b*, 140*c*, 140*d* may be perforated along the adhesive/non-adhesive borders of each detachable section 130*a*, 130*b*, 130*c*, 130*d* enabling easy detachment of the detachable tabs 140*a* 140*b*, 140*c*, 140*d* once one of the smaller detachable sections 130*a*, 130*b*, 130*c*, 130*d* is permanently adhered to a surface, such as, the surface of a prescription bottle.

Figure 4:
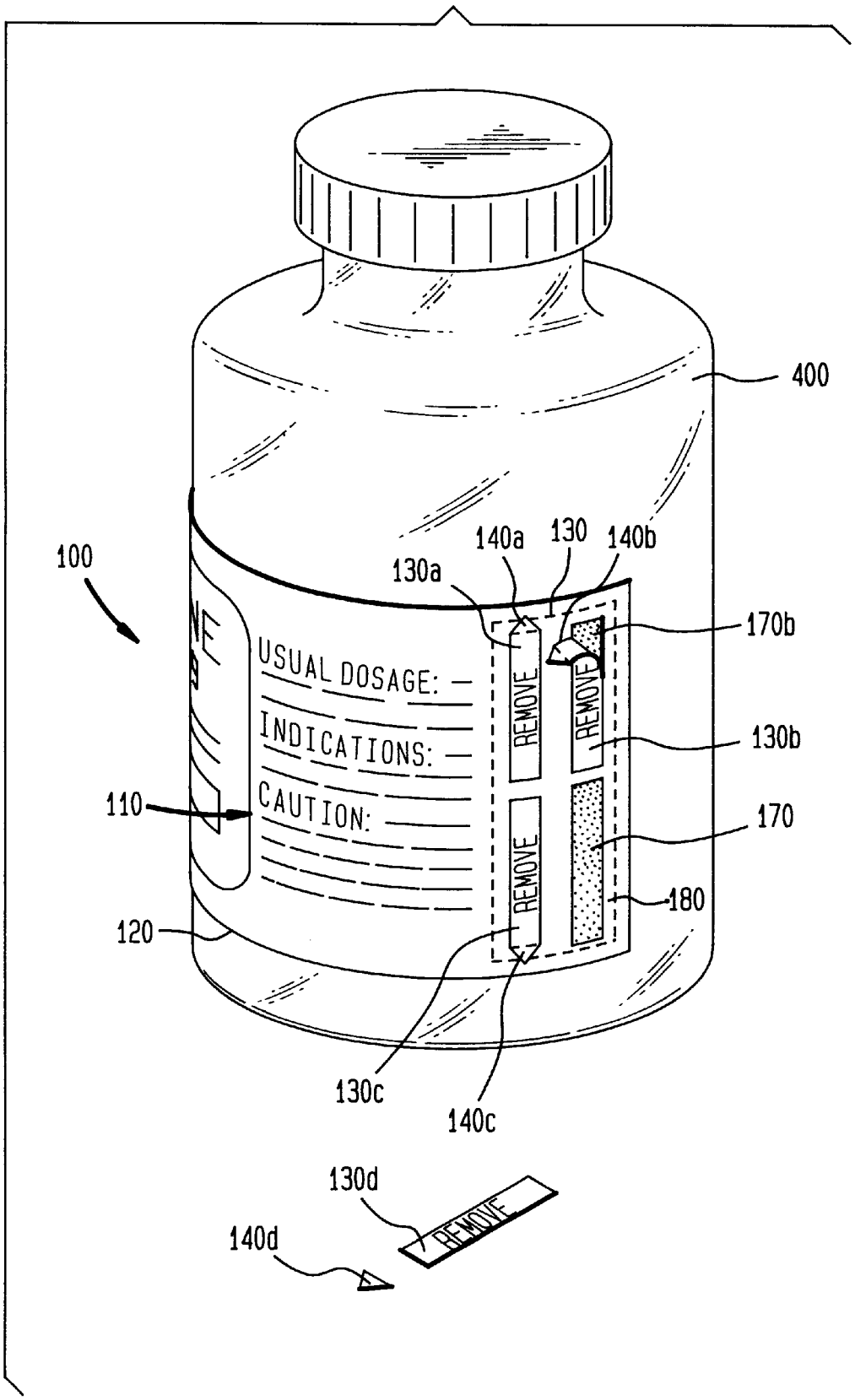
FIG. 4 shows a label of the type shown in FIG. 3 attached to a stock bottle.

FIG. 4 shows a stock bottle 400 equipped with the inventive self-adhesive label according to FIG. 3. It can be seen that the non-adhesive detachable tabs extend upwardly in order to facilitate gripping of the detachable sections by the user.

The inventive self-adhesive label 100 can be easily placed on a bottle during production by an automated process on a packaging line. When bottles to be labelled are placed on a conveyor belt, a web of self-adhesive labels 100 are used. As a bottle approaches, the web is advanced over a sharply angled "peeler plate" which causes the leading edge of the self-adhesive label to "pop off" the release-liner and catch the bottle as it passes. As the bottle continues on the conveyor belt, the web of labels advances allowing the label to completely wrap around the bottle. Since the portion 170 is die-cut from the release-liner 160, it remains under the detachable section 130 and is sealed between the surface of the stock bottle and a portion of the adhesive section.

This allows the detachable section 130 as a whole, or when subdivided into smaller sections 130*a*, 130*b*, 130*c*, 130*d*, to be detached from the bottle while the adhesive section 120 remains permanently attached to the bottle. Once the detachable section 130 is removed from the bottle, it is permanently adhered to another surface, such as, the surface of a prescription bottle.

Therefore, when a pharmacist dispenses medicine from a stock bottle having the self-adhesive label 100, the pharmacist can remove a detachable section 130 (e.g., a sticker) from the self-adhesive label 100 and permanently adhere it to the prescription bottle in which the medication has been dispensed. The detachable section 130 may contain instructions which the patient must follow when taking the medication.

Having the detachable instruction stickers directly attached to the stock bottle enables the pharmacist to be more efficient when filling prescriptions. This is because the detachable instruction stickers to be placed on the prescription bottle are right at the pharmacist's fingertips. In addition, having the detachable instruction stickers attached to the self-adhesive label 100 on the stock bottle reduces the possibility that an incorrect label will be adhered to a prescription bottle.

Although the self-adhesive label has been described in connection with a stock bottle containing a pharmaceutical product, the self-adhesive label may also be used in connection with other bottles.

The above-described embodiments of the invention are intended to be illustrative only. Numerous alternative embodiments may be devised by those skilled in the art without departing from the spirit and scope of the following claims.

We claim:

1. A two-ply self-adhesive label, comprising an adhesive layer superimposed on a release-liner;

(a) said adhesive layer comprising an adhesive section and a die-cut detachable section, each of which has an adhesive backing thereon;

(b) said release-liner including a die-cut portion thereof on which said detachable section is superimposed, said portion being separable from the release liner;

(c) said portion of said release liner on which the detachable section is superimposed being configured so that said portion is removable from the release liner and when said adhesive layer is removed from said release-liner and adhered to a first surface, said detachable section of said adhesive layer remains superimposed on said removed portion of said release liner, and said detachable section of said adhesive layer is removable from said removed portion of the release-liner at a later time so that it can be adhered to a second surface;

(d) said self-adhesive label further comprising a non-adhesive tab connected to said detachable section so as to provide a grip for removing said detachable section from said portion of said release liner after said adhesive layer is adhered to said first surface.

2. The self-adhesive label of claim 1 wherein said portion of said release liner is larger than said detachable section of said adhesive layer and extends under said adhesive section.

3. The self-adhesive label of claim 2 wherein said adhesive section includes a marginal area which encloses at least a part of said portion of said release-liner, so that when said adhesive layer is adhered to said first surface, said marginal area causes said portion of said release-liner to become affixed to said first surface.

4. The self-adhesive label of claim 1 wherein said detachable section comprises a sticker.

5. The self-adhesive label of claim 1 wherein each of said adhesive section and said detachable section of said adhesive layer has a display surface having indicia imprinted thereupon.

6. The self-adhesive label of claim 1 comprising a multiplicity of detachable sections, all of which are superimposed on said portion of said release-liner, wherein each of said multiplicity of detachable sections has a non-adhesive tab connected to it so as to provide a grip for removing each of said detachable sections from said superimposed portion of said release liner.

7. The self-adhesive label of claim 6 wherein said of multiplicity of detachable sections comprises a multiplicity of stickers.

8. The self-adhesive label of claim 1 which is a pharmaceutical label and wherein said first surface comprises a part of a pharmacist's stock bottle.

9. The self-adhesive label of claim 8 wherein said second surface comprises a part of a patient's bottle.

10. The self-adhesive label of claim 1 wherein said tab is detachably connected to said detachable section of said adhesive layer.

11. The self-adhesive label of claim 1 wherein said tab extends upwardly from an upper surface of said adhesive layer.

12. The self-adhesive label of claim 11 wherein said tab extends upwardly from said adhesive layer along a perforated line.

* * * * *